US009038826B2

(12) United States Patent
Cocci

(10) Patent No.: US 9,038,826 B2
(45) Date of Patent: May 26, 2015

(54) STACKABLE CUP

(76) Inventor: Marco David Cocci, Morghill (ZA)

( * ) Notice: Subject to any disclaimer, the term of this patent is extended or adjusted under 35 U.S.C. 154(b) by 1009 days.

(21) Appl. No.: 13/047,271

(22) Filed: Mar. 14, 2011

(65) Prior Publication Data

US 2011/0162992 A1 Jul. 7, 2011

Related U.S. Application Data

(63) Continuation of application No. PCT/IB2009/054125, filed on Sep. 21, 2009.

(30) Foreign Application Priority Data

Sep. 19, 2008 (ZA) ..... 2008/08040

(51) Int. Cl.

| | |
|---|---|
| ***B65D 21/02*** | (2006.01) |
| ***A47G 19/23*** | (2006.01) |
| ***A47G 23/02*** | (2006.01) |
| ***B65D 25/28*** | (2006.01) |
| ***B65D 69/00*** | (2006.01) |

(52) U.S. Cl.

CPC ..... *A47G 19/23* (2013.01); *B65D 21/02* (2013.01); *A47G 23/0216* (2013.01); *B65D 21/0233* (2013.01); *B65D 25/282* (2013.01); *B65D 69/00* (2013.01)

(58) Field of Classification Search

CPC .... B65D 21/02; B65D 21/0233; B65D 21/04; B65D 21/048; A47G 19/22

USPC ..... 206/515, 510, 509, 503; 220/771, 756, 220/519, 703; 215/398; 229/402

See application file for complete search history.

(56) References Cited

U.S. PATENT DOCUMENTS

| | | | |
|---|---|---|---|
| 5,219,419 | A | 6/1993 | Prothe |
| 6,520,366 | B1 | 2/2003 | Bradley et al. |

OTHER PUBLICATIONS

International Search Report with Written Opinion issued by the USPTO as the International Searching Authority on Feb. 12, 2010, for corresponding International Application PCT/IB2009/054125.

*Primary Examiner* — Stephen Castellano

(74) *Attorney, Agent, or Firm* — Myers Wolin, LLC

(57) ABSTRACT

A stackable cup having a rigid handle with an open top, the open top shaped and dimensioned to receive a complementary handle of a stackable cup of the like such that one or more cups may be angularly stacked, the cup having a lip projecting from the open top and extending outwardly to a circular rim, which in turn extends downwardly to define the drinking cup.

4 Claims, 3 Drawing Sheets

STACKABLE CUP

CROSS-REFERENCE TO RELATED APPLICATIONS

This application is a continuation of PCT/IB2009/054125 filed on Sep. 21, 2009, which claims priority to ZA 2008/08040 filed on Sep. 19, 2008, the contents of which are incorporated herein by reference.

FIELD OF THE INVENTION

This invention relates to drinking cups. More particularly, the invention relates to a stackable drinking cup and a stackable drinking cup holder.

BACKGROUND OF THE INVENTION

Drinking cups are used for holding hot or cold beverages, and are usually stackable for efficient storage and transporting of the drinking cups when not in use. When used, a drinking cup is typically removed from a stack of drinking cups, filled with the beverage, and carried by a consumer of the beverage, or carried to the consumer by a person serving the beverage. The carrying or holding of multiple drinking cups containing beverages often results in spilling of the beverages, making it difficult for the person to carry or hold more than two filled drinking cups at a time.

The inventor has identified a need for a mechanism which allows for both the stacking of drinking cups when not in use and when in use and the carrying of multiple beverage-filled cups with minimum spillage. The aim of the present invention is to provide such a mechanism.

SUMMARY OF THE INVENTION

According to a first aspect of the invention there is provided a stackable drinking cup which includes:

a rigid elongate handle including a side wall and an open top, the open top shaped and dimensioned to receive a lower end of a complementary handle of a stackable cup of the like;

a lip projecting laterally from the open top and extending transversely outwards from the open top to define a generally circular rim, the rim extending integrally downwardly to define the drinking cup.

In use, the open top of the handle receives the lower end of the complimentary handle of the stackable cup of the like to permit stacking of two or more of the stackable cups.

In use, the open top may receive the lower end of the complimentary handle of the stackable cup of the like such that the two or more stackable cups are angularly variably stacked about an axis defined by the handles of the two or more stackable cups.

The rigid elongate handle may be a generally conical truncated handle such that the side wall of handle tapers upwards and outwards from the lower end of the handle to the open top of the handle.

The taper of the generally conical truncated handle may have an angle determined by the clearance required between the rim of the stackable cup and the base of a stackable cup of the like when the two or more stackable cups are angularly stacked in a spiral in use.

The lip of the stackable cup may include one or more webs bridged between the rigid handle and the generally circular rim for structurally strengthening the stackable cup.

The rigid handle may have a ruffled surface. The ruffled surface may ideally be a serrated surface. In use, the serrated surface allows a degree of clearance between the handle and a handle of a cup of the like to provide glide ability between the handles upon insertion and separation.

The stackable cup may be moulded, for example injection moulded.

According to another aspect of the invention there is provided a stackable drinking cup holder which includes:

a rigid elongate handle including a side wall and an open top, the open top shaped and dimensioned to receive a lower end of a complementary handle of a stackable cup holder of the like;

a lip projecting laterally from the open top and extending transversely outwards from the open top to define a generally circular rim for seating a drinking cup.

In use, the open top of the handle receives the lower end of the complimentary handle of the stackable cup holder of the like to permit stacking of two or more of the stackable cup holders.

In use, the open top may receive the lower end of the complimentary handle of the stackable cup holder of the like such that the rims of the two or more stackable cup holders are angularly variably stacked about an axis defined by the handles of the two or more stackable cup holders.

The rigid elongate handle may be a generally conical truncated handle such that the side wall of the handle tapers upwards and outwards from the lower end of the handle to the open top of the handle.

The lip of the stackable cup holder may include one or more webs bridged between the rigid handle and the generally circular rim for structurally strengthening the stackable cup holder.

The rigid handle may have a ruffled surface. The ruffled surface may ideally be a serrated surface. In use, the serrated surface allows a degree of clearance between the handle and a handle of a cup holder of the like to provide glide ability between the handles upon insertion and separation.

The stackable cup holder may be moulded, for example injection moulded.

The generally circular rim may extend integrally downwardly to define a drinking cup.

The invention is now described by way of non-limiting example with reference to the accompanying diagrammatic drawings.

BRIEF DESCRIPTION OF THE DRAWINGS

In the figures, unless otherwise indicated, like numerals represents like parts.

EMBODIMENT OF THE INVENTION

Figure 1:
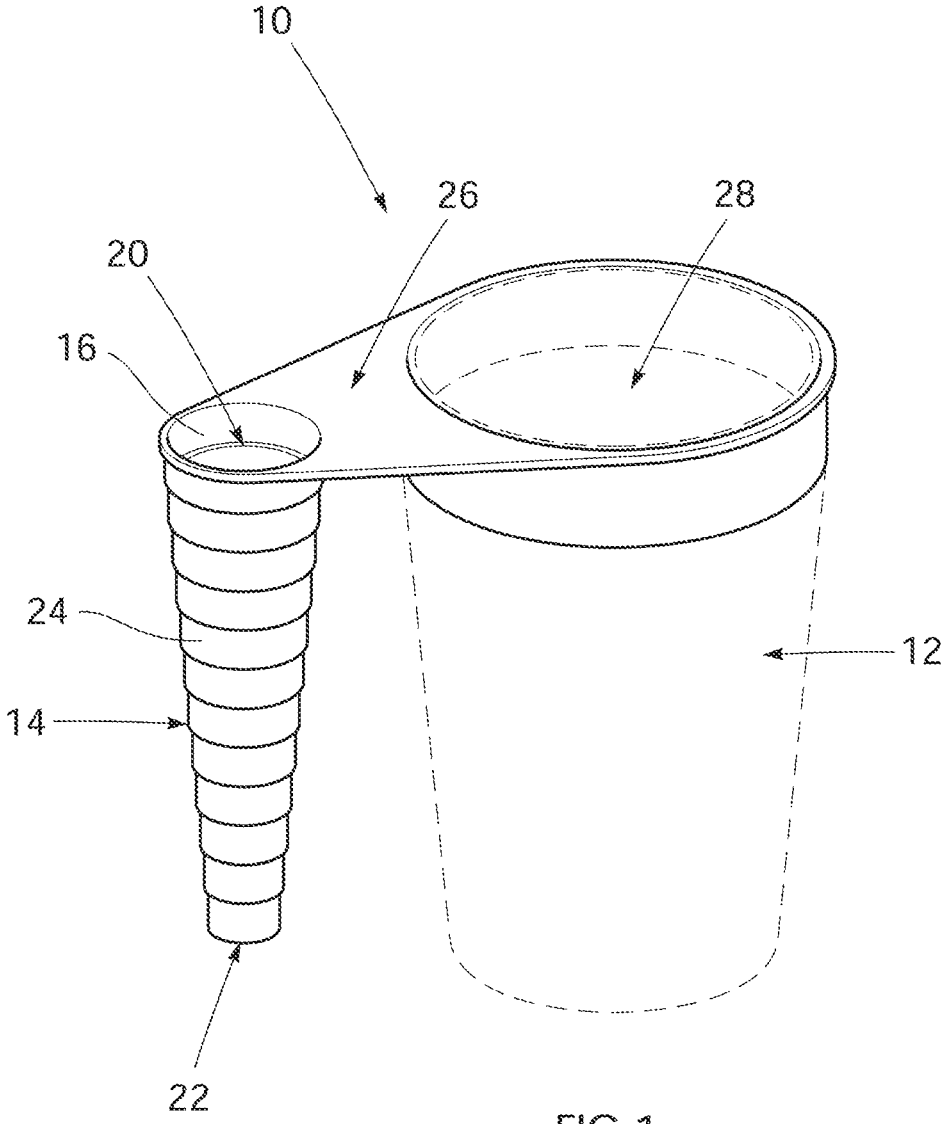
FIG. 1 shows a stackable drinking cup holder according to one aspect of the invention and in use with a drinking cup.

FIG. 1 shows a stackable drinking cup holder in accordance with one embodiment of the invention. Reference numeral 10 generally designates the stackable drinking cup holder, and reference numeral 12 generally designates a disposable drinking cup held by the cup holder 10 in use.

The stackable drinking cup holder 10 has a rigid elongate handle 14, the handle having an open top 16 and a side wall 24, the open top 16 shaped and dimensioned to receive a lower end of a complementary handle of a stackable cup holder of the like (not shown here). A lip 26 projects laterally from the open top 16 and extends transversely outwards from the open top 16 to define a generally circular rim 28 for seating the disposable drinking cup 12. In use and as will become more apparent hereunder, the open top 16 of the handle 14 receives the lower end of the complimentary handle of the stackable cup holder of the like at 20 to permit stacking of two or more of the stackable cup holders.

The rigid handle 14 is a generally conical truncated handle such that the side wall 24 of the handle 14 tapers upwards and outwards from the lower end 22 to the open top 16.

Figure 2:
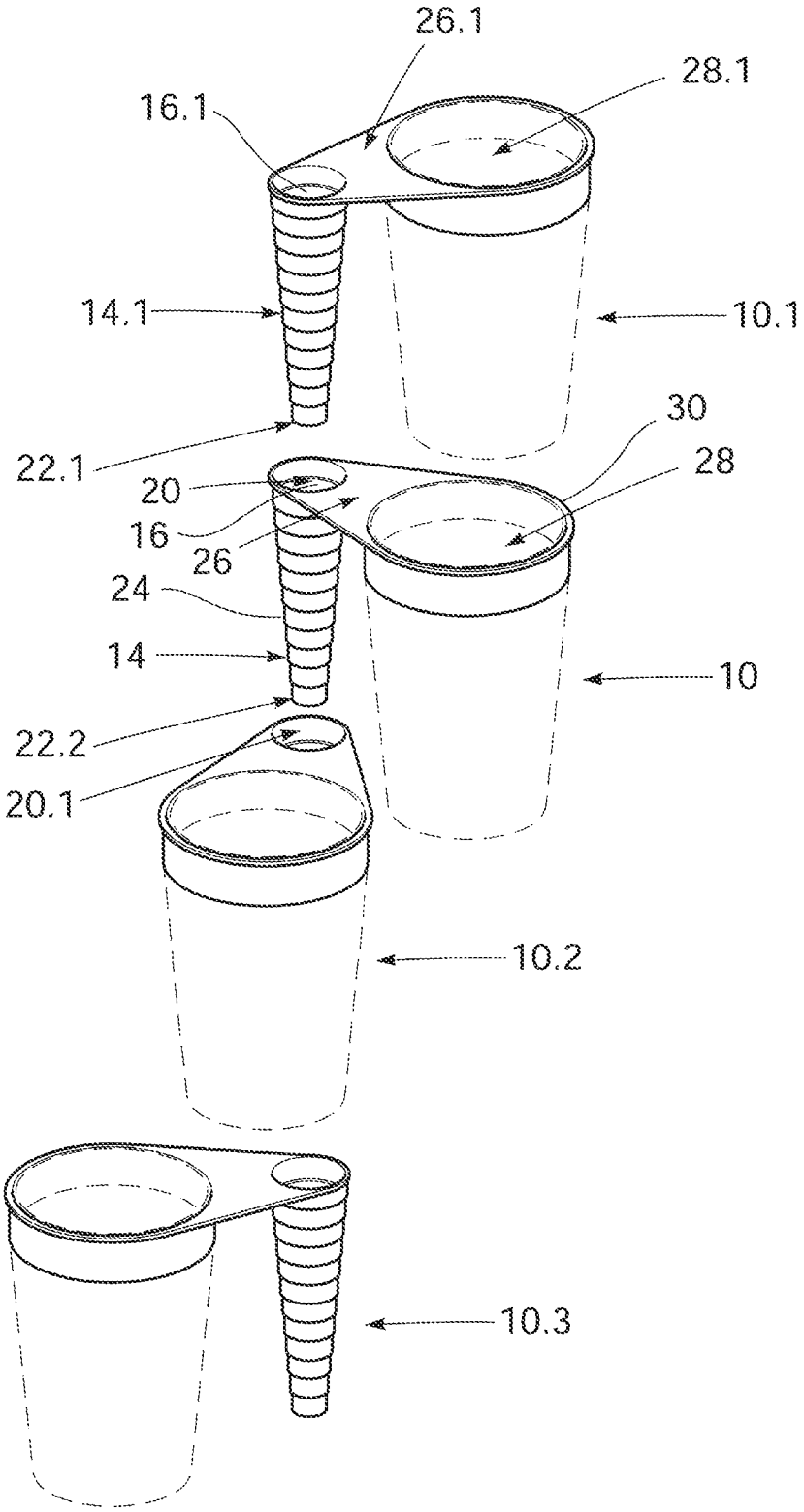
FIG. 2 shows a stackable drinking cup holder according to another embodiment of the invention in use with like drinking cup holders.

Referring now to FIG. 2, reference numeral 10 again generally designates the stackable drinking cup holder of FIG. 1, and shows the holder 10 in use with like drinking cup holders 10.1, 10.2 and 10.3. In use, open top 16 of the handle 14 receives a lower end 22.1 of the drinking cup holder of the like 10.1 to permit stacking of the drinking cup holders 10 and 10.1. The open top 16 of the drinking cup holder 10 receives the lower end 22.1 of the complimentary handle 14.1 of the drinking cup holder 10.1 such that the rims 28 and 28.1 of the stackable cup holders 10 and 10.1 are angularly variably stacked about an axis defined by the handles 14 and 14.1 of the stackable cup holders 10 and 10.1. Similarly, the lower end 22.2 of the drinking cup holder 10 is insurable into the open top 20.1 of the drinking cup 10.2.

The rigid handles 14 and 14.1 have ruffled surfaces in the form of serrated surfaces. In use, the serrated surfaces of the handles 14 and 14.1 allow a degree of clearance between the handles of the respective cup holders to provide glide ability between the handles upon insertion and separation.

Figure 3:
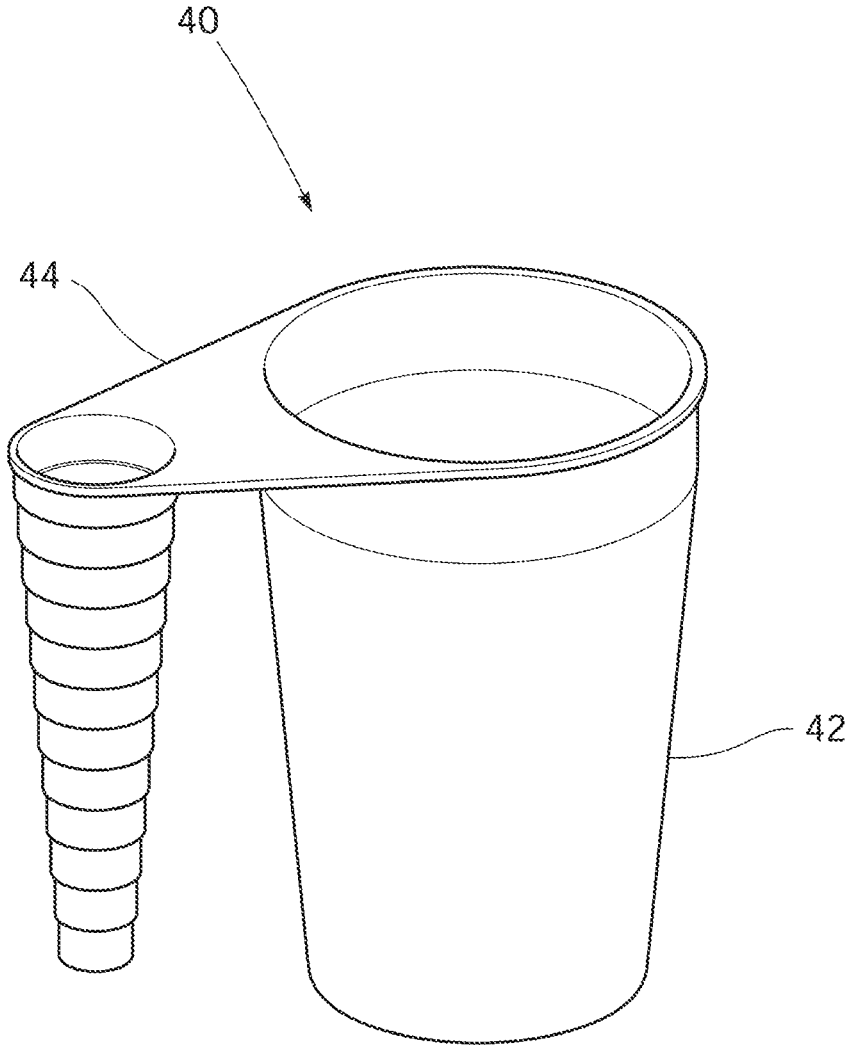
FIG. 3 shows a stackable drinking cup in accordance with another aspect of the invention.

Referring now to FIG. 3, reference numeral 40 denotes a stackable drinking cup in accordance with another aspect of the invention, the drinking cup 40 comprising the drinking cup holder 10 of FIGS. 1 and 2 wherein the rim 44 of the cup extends integrally downwardly to 42 to define the drinking cup. The cup 40 is integrally moulded by way of injection moulding.

Advantageously, when stacked in use, a clearance space between the drinking cup holder handle and the handle of a drinking cup holder of the like afforded by the serrated surfaces of the drinking cup holder handles eases separation of the drinking cups or drinking cup holders when removing them from a stack.

I claim:

1. A stackable drinking cup comprising:

a rigid elongate handle having a side wall and an open top, the open top shaped and dimensioned to receive a lower end of a complementary handle of a stackable cup of the like to permit stacking of two or more cup handles of the like, wherein the rigid handle has a ruffled surface to provide gliding clearance between a handle inner surface and a handle outer surface of a cup of the like during insertion and separation of the handles, the ruffled surface being defined by concentric stepped sections having progressively smaller diameters from the top of the handle towards the bottom of the handle; and a lip projecting laterally from the open top and extending transversely outwards from the open top to define a generally circular rim, the rim extending integrally downwardly to define the drinking cup such that the two or more cups are angularly variably stackable about an axis defined by the handles of the two or more cups.

2. A stackable drinking cup as claimed in claim 1, wherein the rigid elongate handle is a generally conical truncated handle of which the sidewall of the handle tapers upwards and outwards from the lower end of the handle to the open top of the handle.

3. A stackable drinking cup as claimed in claim 2, wherein the taper of the generally conical truncated handle has a taper determined by the clearance required between the rim of the stackable cup and the base of a stackable cup of the like when the two or more stackable cups are angularly stacked in a spiral.

4. A stackable drinking cup as claimed in claim 3, wherein the lip of the stackable cup includes one or more webs bridged between the rigid handle and the generally circular rim for structurally strengthening the stackable cup.

* * * * *